US007882776B2

(12) United States Patent
Medwell et al.

(10) Patent No.: US 7,882,776 B2
(45) Date of Patent: Feb. 8, 2011

(54) VEHICLE ARMOR INCORPORATING GRID WITH CARBON FIBERS

(75) Inventors: Roger Terence Arthur Medwell, Coventry (GB); Christopher Davies, Kenilworth (GB)

(73) Assignee: NP Aerospace Limited, Coventry (GB)

( * ) Notice: Subject to any disclaimer, the term of this patent is extended or adjusted under 35 U.S.C. 154(b) by 692 days.

(21) Appl. No.: 11/849,627

(22) Filed: Sep. 4, 2007

(65) Prior Publication Data

US 2008/0257141 A1 Oct. 23, 2008

(30) Foreign Application Priority Data

Apr. 20, 2007 (GB) ..... 0707752.2

(51) Int. Cl.
*F41H 5/02* (2006.01)
*F41H 7/00* (2006.01)

(52) U.S. Cl. ..... 89/36.02; 89/36.07; 89/929; 89/930; 428/911; 109/49.5

(58) Field of Classification Search ..... 89/36.01–36.08; 428/911; 109/49.5; 114/9
See application file for complete search history.

(56) References Cited

U.S. PATENT DOCUMENTS

| | | | | |
|---|---|---|---|---|
| 1,385,897 | A * | 7/1921 | Tresidder | 114/9 |
| 1,657,915 | A * | 1/1928 | Calamita | 114/9 |
| 2,323,853 | A * | 7/1943 | Simeone | 114/9 |
| 3,586,236 | A * | 6/1971 | Schaffler | 239/172 |
| 3,769,142 | A * | 10/1973 | Holmes et al. | 428/113 |
| 3,942,598 | A * | 3/1976 | Council | 180/6.5 |
| 4,879,165 | A * | 11/1989 | Smith | 428/212 |
| 4,923,741 | A * | 5/1990 | Kosmo et al. | 442/187 |
| 5,102,723 | A * | 4/1992 | Pepin | 428/223 |
| 5,221,807 | A * | 6/1993 | Vives | 89/36.02 |
| 6,481,782 | B2 * | 11/2002 | Bond | 296/187.07 |
| 6,568,310 | B2 * | 5/2003 | Morgan | 89/36.02 |
| 6,647,855 | B1 * | 11/2003 | Christiansen et al. | 89/36.01 |
| 6,898,908 | B2 * | 5/2005 | Messenger et al. | 52/268 |
| 7,073,538 | B2 * | 7/2006 | Bhatnagar et al. | 139/383 R |
| 2004/0221712 | A1 * | 11/2004 | Stewart et al. | 89/36.05 |
| 2005/0217471 | A1 * | 10/2005 | Benitsch | 89/36.02 |
| 2005/0258572 | A1 * | 11/2005 | Messenger et al. | 264/333 |
| 2006/0218870 | A1 * | 10/2006 | Messenger et al. | 52/414 |
| 2007/0180983 | A1 * | 8/2007 | Farinella et al. | 89/36.07 |
| 2008/0017020 | A1 * | 1/2008 | Casper | 89/36.01 |

FOREIGN PATENT DOCUMENTS

| | | |
|---|---|---|
| DE | 19735594 | 2/1999 |

(Continued)

OTHER PUBLICATIONS

UK Intellectual Property Office, "Patents Act 1977: Search Report Under Section 17(5)", in Application No. GB0707752.2, Jun. 28, 2007, 5 pages.

*Primary Examiner*—Michael Carone
*Assistant Examiner*—Michael D David
(74) *Attorney, Agent, or Firm*—Clement A. Berard, Esq.; Dann, Dorfman, Herrell & Skillman, P.C.

(57) ABSTRACT

Armor for a vehicle comprises a grid of bars, at least the majority of the bars being formed from carbon fiber. The carbon fiber bars may be pultruded and some of the bars may be metallic.

8 Claims, 3 Drawing Sheets

FOREIGN PATENT DOCUMENTS

| | | |
|---|---|---|
| FR | 503320 | 6/1920 |
| FR | 2637063 | 3/1990 |
| FR | 2819229 | 7/2002 |
| GB | 0127660 | 6/1919 |
| GB | 1208542 | 10/1970 |

* cited by examiner

VEHICLE ARMOR INCORPORATING GRID WITH CARBON FIBERS

This Application claims the benefit of U.K. Patent Application Number 0707752.2 filed 20 Apr. 2007, which is incorporated herein by reference.

This invention relates to armor for a vehicle.

It is known to provide "bar armor" comprising a grid of bars, generally of steel, and struts for locating the grid at a spacing from a vehicle hull.

SUMMARY OF THE INVENTION

It is an aim of the invention to provide bar armor that can mitigate the threat from rocket propelled grenades to the same extent as the known bar armor without the considerable areal density of that armor.

The invention provides a grid of bars for armoring a vehicle, at least the majority of the bars being formed from carbon fiber.

Some of the bars, in particular vertical bars, of the grid, may be metallic, e.g. of aluminum. Thus the grid may consist of metallic vertical bars and horizontal carbon fiber bars.

The carbon fiber bars may be pultruded and may extend through slots in the metallic bars.

The areal density of the inventive grid can be less than about 20 kg/m$^2$, e.g. less than about 15 kg/m$^2$, and in particular 10-12 kg/m$^2$, as compared with the known bar armor having an areal density of about 40 kg/m$^2$.

The armor may include struts for securing the grid to a vehicle hull, the struts being arranged to maintain a suitable spacing between the grid and the hull.

BRIEF DESCRIPTION OF THE DRAWINGS

A particular embodiment of the invention will now be described, by way of example only, with reference to the accompanying drawings, in which.

DETAILED DESCRIPTION OF PARTICULAR EMBODIMENTS

Figure 1:
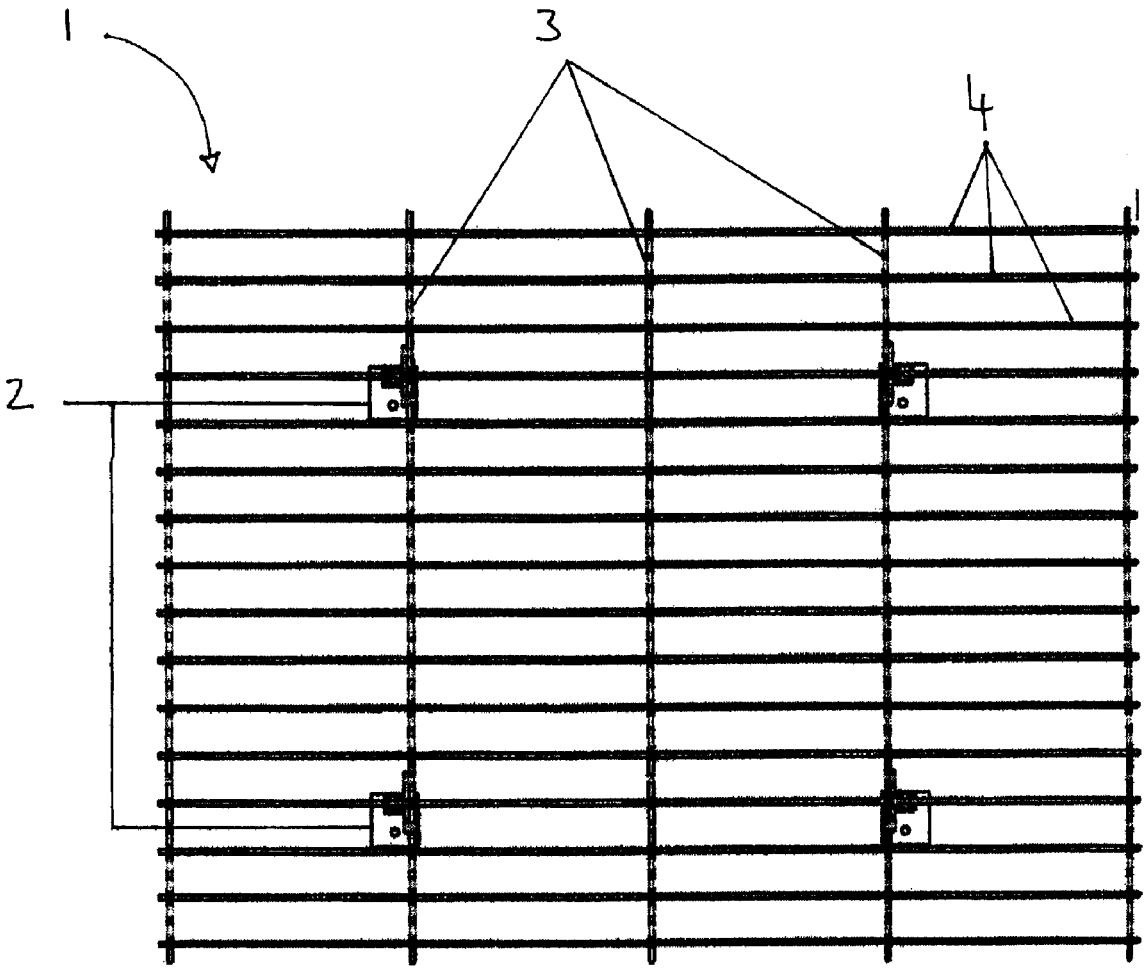
FIG. 1 is a front view of the vehicle armor according to the invention.
Figure 2A:
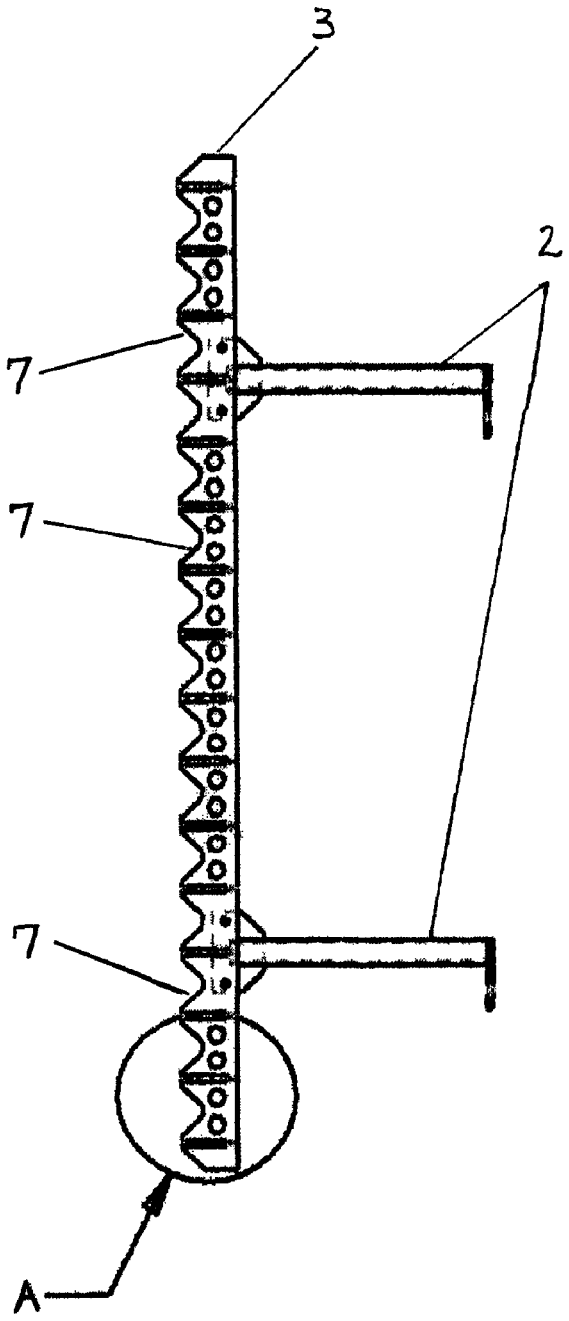
FIG. 2A is a side view of the armor of FIG. 1.
Figure 2B:
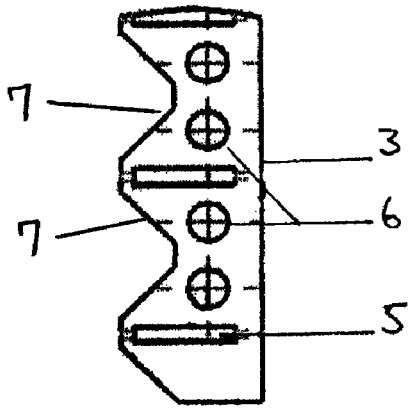
FIG. 2B is an enlarged view of a portion of the side view in FIG. 2A.

FIGS. 1, 2A and 2B show a grid of bars 1 with struts 2 that allow the grid 1 to be attached to the hull of a vehicle. The struts 2 provide a standoff separation of 0.2 m to 0.3 m e.g. approximately 0.24 m from the hull of the vehicle. The vertical bars 3, which are manufactured from aluminum, are 0.2 m to 0.4 m, e.g. approximately 0.3 m apart and the horizontal bars 4, which are manufactured from pultruded continuous filament carbon fiber, are approximately 0.01 m to 0.1 m, e.g. approximately 0.057 m apart.

The carbon fiber bars 4 do not require special manufacture as they are currently available on the market as aircraft floor components. They are arranged in a "flat" configuration and thus present to incoming threats a minimized profile. This reduces the probability of the nose fuse in an incoming grenade impacting with a horizontal bar 4.

FIGS. 2A and 2B are side views of the armor showing the horizontal bars 4 extending through slots 5 in the vertical bars 3. Struts 2 are provided for securing the grid 1 to a vehicle hull and are bolted to selected vertical bars 3 via mounting holes 6. Each of bars 3 has an edge 7 that may be a scalloped or sawtooth edge 7 wherein a substantial portion of that edge 7 is angled with respect to the plane in which grid 1 lies. The edge-to-edge dimension of bar 3 is larger at locations proximate the slots 5 in which bars 4 are disposed and is smaller at locations intermediate slots 5. Edge 7 is at a face of grid 1 that is opposite to struts 2 and so would be facing away from a vehicle hull to which grid 1 is mounted.

Figure 3:
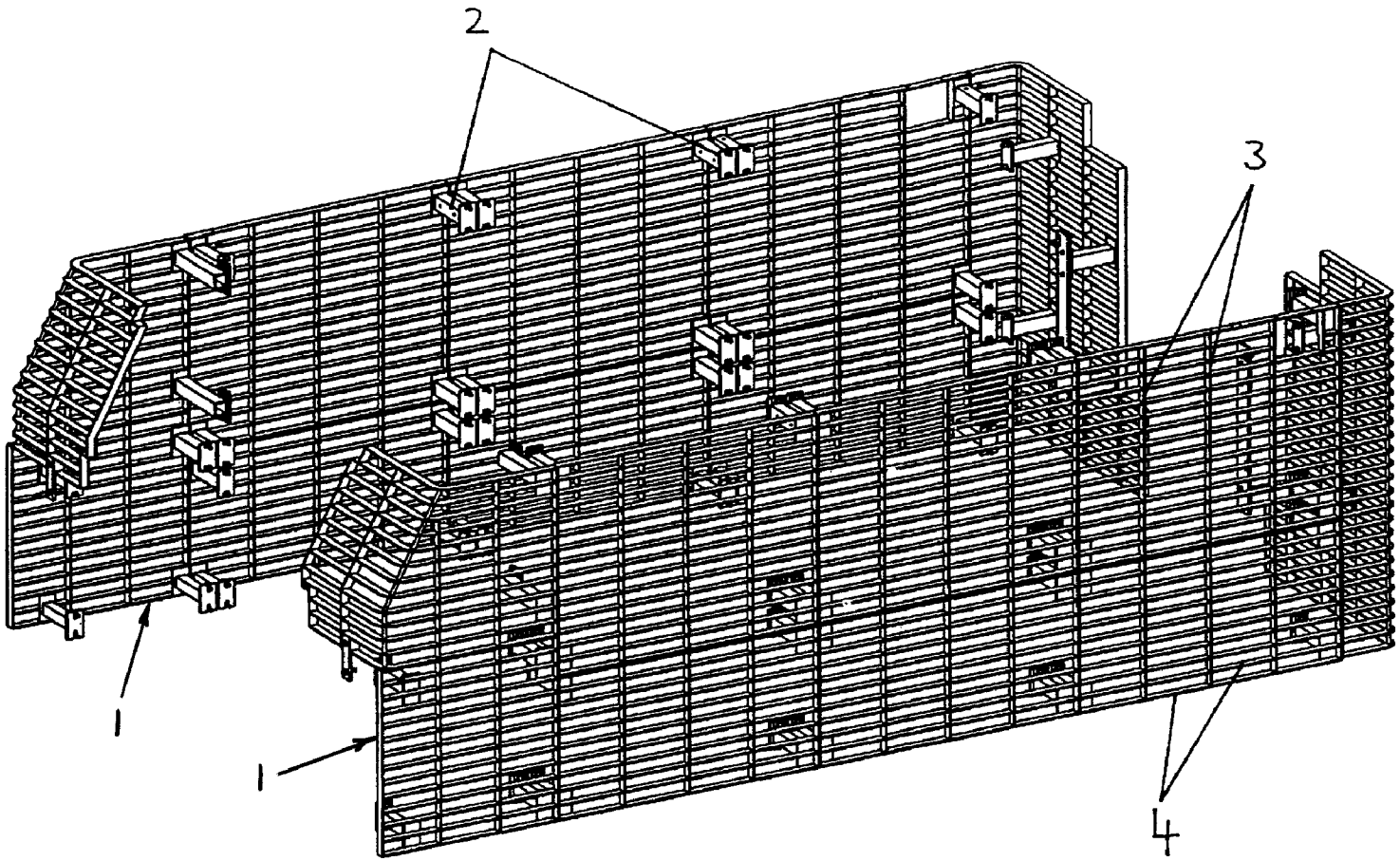
FIG. 3 is an isometric view of a cage constructed from a plurality of grids, one of which is shown in FIG. 1.

FIG. 3 is an isometric view of a cage constructed from a plurality of grids 1, one of which is shown in FIG. 1. Grids 1 need not be planar, but may be shaped in a desired configuration, and struts 2 may be in selected locations, e.g., on non-adjacent bars 3, as shown.

Armor 1 for a vehicle may comprise: a grid 1 of bars 3, 4, a majority of the bars 3, 4 being formed from carbon fiber. The carbon fiber bars 3, 4 may be pultruded, and some of the bars may be metallic. The carbon fiber bars 4 may extend through slots 5 in the metallic bars 3. The areal density of the grid 1 may be less than about 20 kg/m$^2$. Armor 1 may further comprise struts 2 for securing the grid 1 to a vehicle hull, and some of the bars 3 may have a sawtooth shaped edge 7.

Armor 1 for a vehicle may comprise: a grid 1 of bars 3, 4, wherein a majority of the bars 3, 4 are formed of carbon fiber, the grid 1 of bars 3, 4 including: a plurality of first bars 3 arranged substantially parallel to each other in a first direction; and a plurality of second bars 4 arranged substantially parallel to each other in a second direction that is substantially perpendicular to the first direction; and a plurality of struts 2 attached to ones of the plurality of first bars 3 for securing the grid 1 of bars 3, 4 to a vehicle hull. Some of the bars 3 may be metallic; and the carbon fiber bars 4 may extend through slots 5 in the metallic bars 3. The areal density of the grid 1 of bars 3, 4 may be less than about 20 kg/m$^2$. Armor 1 may further comprise struts 2 attached to non-adjacent ones of the plurality of first bars for securing the grid 1 of bars 3, 4 to a vehicle hull, and some of the bars 3 may have a sawtooth shaped edge 7.

Armor 1 for a vehicle may comprise: a grid 1 of bars 3, 4 wherein a majority of the bars 3, 4 are formed of carbon fiber, the grid 1 of bars 3, 4 including: a plurality of metallic bars 3 arranged substantially parallel to each other in a first direction, each metallic bar 3 having a plurality of slots 5 therein; and a plurality of carbon fiber bars 4 arranged substantially parallel to each other in a second direction that is substantially perpendicular to the first direction, wherein the carbon fiber bars 4 are spaced closer together than are the metallic bars 3 and wherein the carbon fiber bars 4 are disposed in the slots 5 of the plurality of metallic bars 3; and a plurality of support struts 2 attached to non-adjacent ones of the plurality of metallic bars 3 for supporting the grid 1 of bars 3, 4 adjacent a vehicle hull. The areal density of the grid 1 of bars is less than about 20 kg/m$^2$. Some of the metallic bars 3 may have a sawtooth shaped edge 7.

The invention claimed is:

1. Armor for a vehicle comprising:

a grid of bars wherein a majority of the bars are formed of carbon fiber, the grid of bars including:

a plurality of metallic bars arranged substantially parallel to each other in a first direction; and a plurality of carbon fiber bars arranged substantially parallel to each other in a second direction that is substantially perpendicular to the first direction; and a plurality of struts for securing the grid of bars to a vehicle hull.

2. Armor according to claim 1 wherein the carbon fiber bars extend through slots in the metallic bars.

3. Armor according to claim 1 wherein the areal density of the grid of bars is less than about 20 kg/$m^2$.

4. Armor according to claim 1 further comprising struts attached to non-adjacent ones of the plurality of first bars for securing the grid of bars to a vehicle hull.

5. Armor according to claim 1 wherein some of the bars have a sawtooth shaped edge.

6. Armor for a vehicle comprising:

a grid of bars wherein a majority of the bars are formed of carbon fiber, the grid of bars including:

a plurality of metallic bars arranged substantially parallel to each other in a first direction, each metallic bar having a plurality of slots therein; and a plurality of carbon fiber bars arranged substantially parallel to each other in a second direction that is substantially perpendicular to the first direction, wherein the carbon fiber bars are spaced closer together than are the metallic bars and wherein the carbon fiber bars are disposed in the slots of the plurality of metallic bars; and a plurality of support struts attached to non-adjacent ones of the plurality of metallic bars for supporting the grid of bars adjacent a vehicle hull.

7. Armor according to claim 6 wherein the areal density of the grid of bars is less than about 20 kg/$m^2$.

8. Armor according to claim 6 wherein some of the metallic bars have a sawtooth shaped edge.

* * * * *